US005372111A

United States Patent [19]

Maier et al.

[11] Patent Number: 5,372,111

[45] Date of Patent: Dec. 13, 1994

[54] FUEL INJECTION PUMP WITH SPEED GOVERNOR

[75] Inventors: Sieghart Maier, Gerlingen; Siegfried Ruthardt, Stuttgart; Jürgen Hanneke, Gerlingen, all of Germany

[73] Assignee: Robert Bosch GmbH, Stuttgart, Germany

[21] Appl. No.: 946,486

[22] PCT Filed: Feb. 26, 1992

[86] PCT No.: PCT/DE92/00147

§ 371 Date: Nov. 3, 1992

§ 102(e) Date: Nov. 3, 1992

[87] PCT Pub. No.: WO92/17695

PCT Pub. Date: Oct. 15, 1992

[30] Foreign Application Priority Data

Mar. 30, 1991 [DE] Germany ..... 4110578

[51] Int. Cl.[5] ..... F02D 31/00

[52] U.S. Cl. ..... 123/373; 123/358; 123/364

[58] Field of Search ..... 123/372, 373, 357, 358, 123/359

[56] References Cited

U.S. PATENT DOCUMENTS

| | | | |
|---|---|---|---|
| T998,002 | 9/1980 | Miller | 123/358 |
| 2,317,022 | 4/1943 | Benjamin | 123/373 |
| 2,961,229 | 11/1960 | Parks | 123/364 |
| 3,613,651 | 10/1971 | Snyder | 123/373 |
| 3,923,026 | 12/1975 | Aoki | 123/372 |
| 4,308,833 | 1/1982 | Makino | 123/373 |
| 4,350,127 | 9/1982 | King | 123/364 |
| 4,604,977 | 8/1986 | Ohnishi | 123/373 |
| 5,063,900 | 11/1991 | Augustin | 123/373 |
| 5,203,301 | 4/1993 | Maier | 123/373 |

FOREIGN PATENT DOCUMENTS

| | | | |
|---|---|---|---|
| 721634 | 11/1942 | Germany . | |
| 2855812 | 6/1979 | Germany | 123/358 |
| 0185826 | 10/1984 | Japan | 123/373 |
| 0043931 | 3/1987 | Japan | 123/373 |
| 818825 | 3/1957 | United Kingdom . | |

*Primary Examiner*—Carl S. Miller
*Attorney, Agent, or Firm*—Michael J. Striker

[57] ABSTRACT

The setting of the full load stop cam of a speed governor can be effected by simple means in a manner which is advantageous in terms of production technology. This simplification of the final setting of the cam (13) which is designed as a full load stop cam is achieved by combining the cam (13) with the lid (12) of the housing (11) of the fuel injection pump speed governor, to form a single structual unit, with adjusting elements being provided on the lid (12) which facilitate simple means of adjustment of the cam (13). This setting device for fuel apportioning is used in speed governors of fuel injection pumps.

9 Claims, 3 Drawing Sheets

FUEL INJECTION PUMP WITH SPEED GOVERNOR

BACKGROUND OF THE INVENTION

The invention relates to a speed governor for fuel injection pumps.

If the performance characteristics, and hence the full load range of such a fuel injection pump is to be altered, then the housing must be opened by removing a lid while the fuel injection pump is at rest to enable re-adjustment of the cam, which has a scanning area for a scanning member and which determines the full load volume to be made. This adjustment must be tested for its efficiency on a test rig—with the fuel injection pump closed—and possibly corrected again with the fuel injection pump again at rest and opened.

This elaborate setting of the cam for the full load injection volume can be simplified.

SUMMARY OF THE INVENTION

According to the invention the fuel injection pump with a speed governor, comprises a housing including a lid; a cam mounted on the lid; a scanning member for controlling a full load injection volume depending on a number of revolutions, the cam having a scanning face for the scanning member; and adjusting means for adjusting a position of the cam relative to the lid to set a position of contact of the scanning member on the scanning face of the cam.

It is an object of the present invention to provide a fuel injection pump with a speed governor in which the above described disadvantage is avoided, and the final setting of the cam is achieved by simple means.

This simplification of the final setting of the cam is made possible by the combination of the cam with the fuel injection pump speed governor housing lid, to form a single unit.

This leads to an economic setting of the fuel injection pump with regard to its performance characteristic in the full load range.

There are several possible embodiments of the invention.

In one embodiment of the fuel injection pump the lid is provided with a groove in an underside of the lid and the cam is arranged in the groove substantially parallel to a base plane of the lid. The device further comprises a fixing screw securing the cam to the underside of the lid and passing through the lid. The apparatus also can include shim means for changing a vertical separation between the cam and the lid between the cam and the groove.

In another embodiment of the invention the apparatus can include at least one cap screw passing through the lid and engaging in the cam for adjustment of a vertical displacement of the cam relative to the lid and at least one shim insertable between the lid and the cam. The shim is brought to rest against the lid and the cam by turning the at least one cap screw. The lid is provided with at least one vertically oriented hole and the cam is also provided with at least one vertically oriented hole. Each of the vertically oriented holes of the cam is substantially coaxial with an associated vertically oriented hole of the lid. At least one parallel pin is inserted as a guide element in one of the vertically oriented holes and extends into the associated vertically oriented hole to provide an anti-torsion device.

In a preferred embodiment of the invention the means for adjusting a position of the cam relative to the lid and the scanning member comprises at least two setscrews screwed through the lid. The apparatus also includes a return spring between the lid and the cam supported on the lid and surrounding one of the setscrews to provide a pressure on the cam urging the cam away from the lid and a collar on an end of the one setscrew having the return spring and penetrating the cam. A pin is provided and is held fixed in the housing horizontally oriented and positioned to engage with a running clearance in a groove of the cam extending parallel to each of the setscrews. The scanning surface advantageously is curved and the means for adjusting a position of the cam relative to the lid are structured to move the cam vertically relative to the lid. The other set screws is provided with a shaft having an eccentric engaged in an elongated hole provided in the cam and elongated in one direction, the eccentric being oriented substantially perpendicular to the pin and another elongated hole is provided in the cam spaced from the one elongated hole and elongated in a direction perpendicular to the direction the elongated hole is elongated.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENTS

Figure 1:
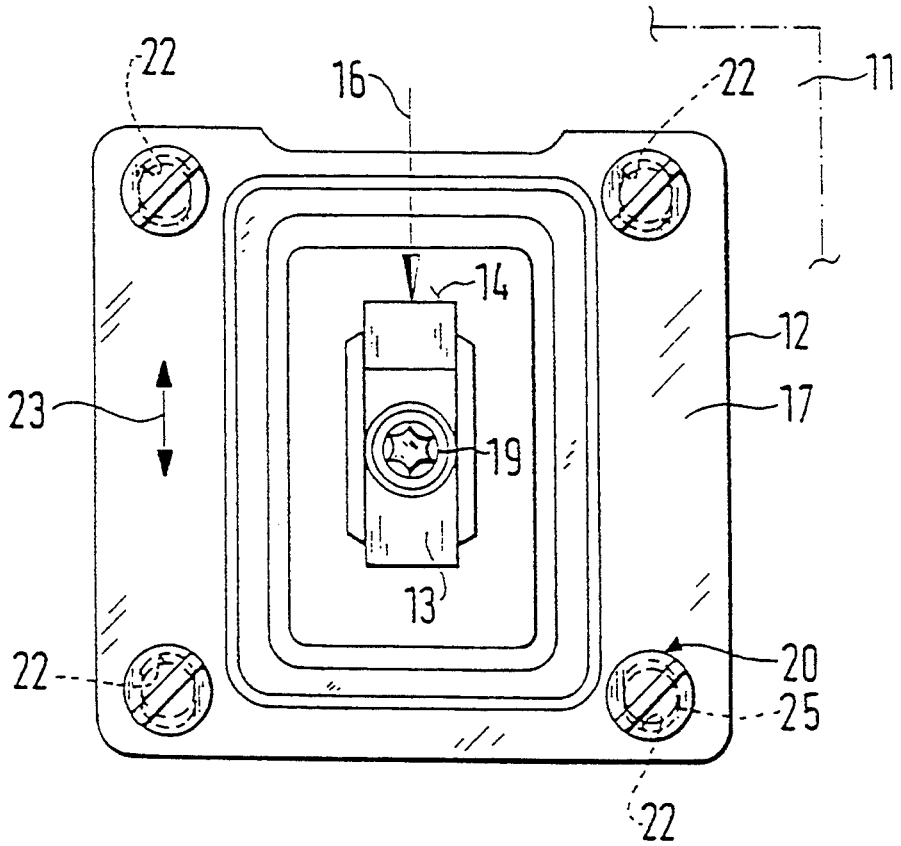
FIG. 1 is a bottom view of lid with a cam according to a first embodiment of the invention.

A lid 12 is fitted on a housing 11, indicated only in FIG. 1, therefore not shown in detail, of a known speed governor of a fuel injection pump. A cam 13 with a scanning face 14 is fitted to the lid 12, acting in the usual manner in conjunction with a scanning member 16, shown only symbolically with a dashed line.

The scanning member 16 can be adjusted, dependent on the position of centrifugal weights of the speed governor, as a function of the engine speed of an internal combustion engine. Due to the combined action of the scanning member 16 with the cam 13, the full load injection volume of the fuel injection pump is specified.

For the fine adjustment of the full load injection volume, the fitting position of the cam 13 with respect to the scanning member 16, which adheres in a positively locking manner, can be altered.

Figure 2:
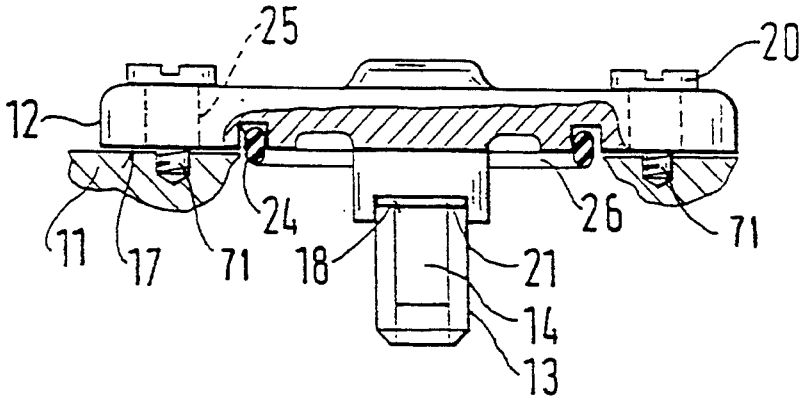
FIG. 2 is a side view of the lid with the cam shown in FIG. 1.

In the first embodiment example in accordance with FIGS. 1 and 2, the cam 13 which is essentially of cuboid shape and has the scanning face 14 formed on its front face, is inserted in a groove 18 formed on a lid underside 17. The cam 13 is fixed and can be removed by a locking screw 19 which is screwed through the lid 12.

For the vertical adjustment of the cam 13 by a varying insertion depth of the cam 13 in the groove 18, the relative position of the scanning member 16 to the housing 11 in the vertical direction is measured, with the lid 12 removed. Depending on this measurement, shims 21 are inserted between the groove 18 and the cam 13. These are brought to rest on the cam 13, on the one hand, and in the groove 18 and thus on the lid 12 on the other hand, by tightening the locking screw 19.

The structural unit comprising the lid 12 and the cam 13 is placed on the housing and secured on the housing 11 by collar screws 20. To facilitate this, the lid 12 which has an almost square cross-sectional area, has an elongated hole 22 in each corner region, through which the collar screws 20 are inserted in the threaded holes 71 of the housing 11 which are nearly coaxial to and correspond to the elongated holes 22. The elongated holes 22 extend in the same longitudinal direction as indicated with the arrow 23, with their width being slightly greater than the diameter of a collar 25 of the collar screws 20.

According to the longitudinal dimension of the elongated holes 22, the lid 12 can be slid in the direction of the arrow 23 on the housing 11, and hence, the cam 13, which is firmly connected to the lid 12, can be horizontally adjusted, relative to the scanning member 16, and fixed.

To seal the lid 12 with the housing 11, an 'O' ring is placed in an annular groove 24 on the lid underside 17 and is retained in position on the housing 11 between the annular groove 24 and the housing 11, when the lid 12 is fixed by the collar screws 20.

Figure 3:
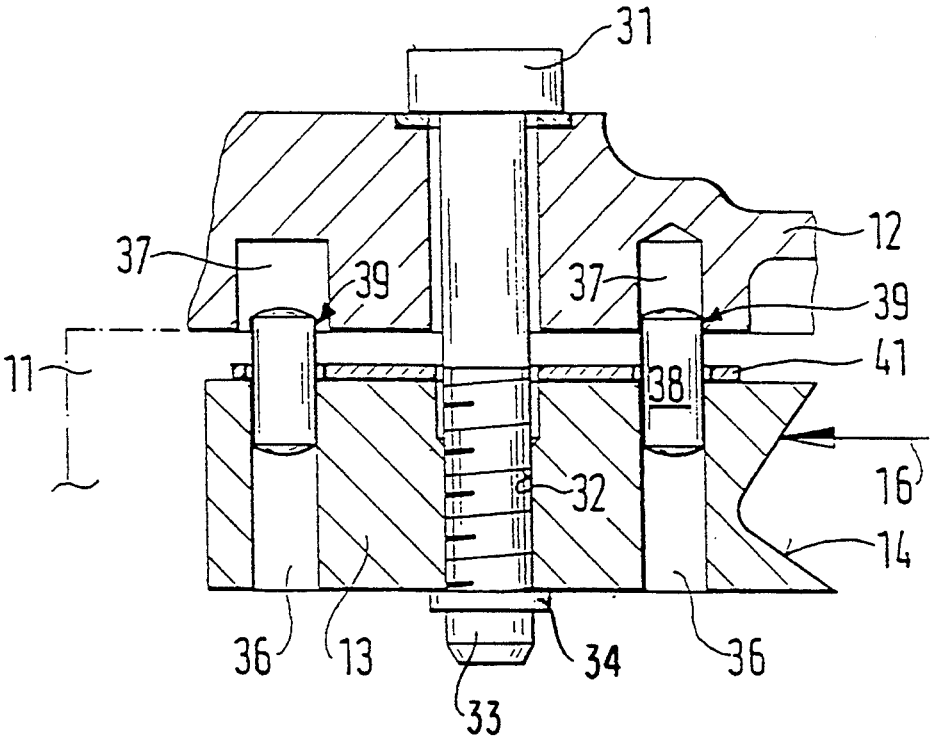
FIG. 3 is a cross-sectional view of a second embodiment of the lid with the cam according to the invention.

In the second embodiment example in accordance with FIG. 3, the lid 12—in contrast to the first embodiment example—is fixed by screws onto the housing 11 without an adjustment facility. The lid 12 and the cam 13 are connected with each other by a cap screw 31 which is guided in the lid 12 with clearance and which is screwed into a threaded hole 32 provided in the cam 13.

A retainer ring 34 which is provided in the region 33 of the cap screw 31 limits the screw-out depth of the cap screw 31 from the cam 13 and secures the connection between the cap screw 31 and the cam 13.

The lid 12 and the cam 13 each have two holes 36,37 which are arranged with their axes equally oriented vertically. The holes 36 of the cam 13 each have a parallel pin 38 inserted in them with a press fit, the end portions 39 of which project into the associated holes 37 of the lid 12. For positional allocation between the cam 13 and the lid 12, one of the holes 37 has a diameter which is slightly larger than the diameter of the parallel pins 38, whereas the other hole 37 is designed as an elongated hole for tolerance compensation for the axial separation of the parallel pins 38.

Due to the guidance of the parallel pins 38 in the holes 37 of the lid 12, the vertical movement of the cam 13 to the lid 12 can be achieved without a horizontal side movement.

In the same way as effected by the shims 21 in the first embodiment example, the vertical separation between the lid 12 and the cam 13 is adjusted by shims 41 in the second embodiment example, which can be inserted between the cam 13 and the lid 12 and fixed by tightening the cap screw 31. The vertical adjustment of the cam 13 to the lid 12 and to the scanning member 16, which rests against the scanning area 14, is thus provided.

Figure 4:
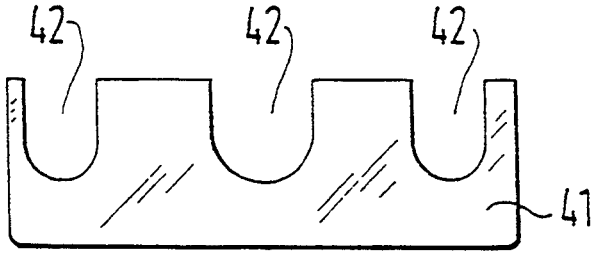
FIG. 4 is a plan view of a shim used for vertical adjustment of a cam and lid according to the invention.

FIG. 4 shows the shim 41. Its cutouts 42 which are associated with the parallel pins 38 and the cap screw 31 are open at the side and facilitate lateral insertion between the lid 12 and the cam 13, without removal of these components.

In the second embodiment example, the horizontal allocation of the cam 13 to the scanning member 16 is by means not shown, with which the position of the scanning member 16 can be altered within the housing 11.

Figure 5:
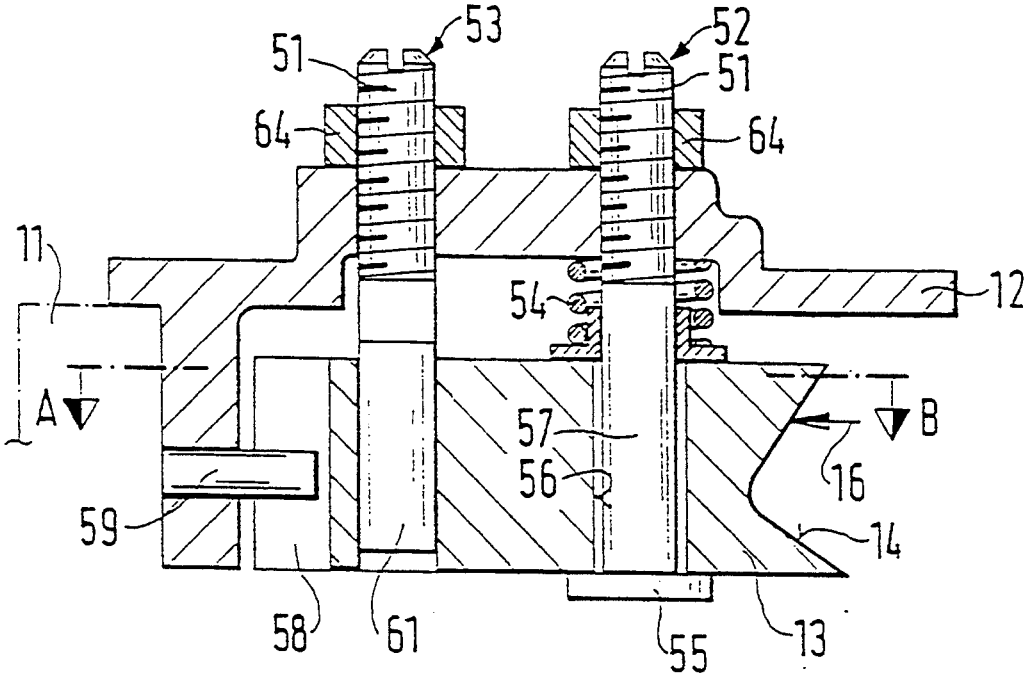
FIG. 5 is a cross-sectional view through a third embodiment example of the assembly according to the invention with two adjusting screws.
Figure 6:
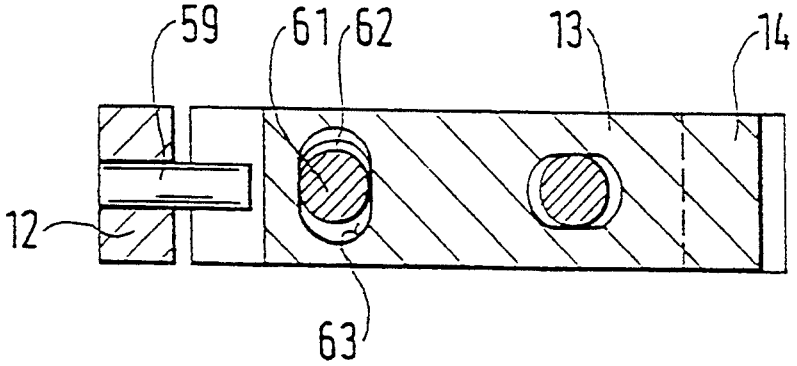
FIG. 6 is a cross-sectional view through the device shown in FIG. 5 taken along the section line A-B in FIG. 5.

In a third embodiment example in accordance with FIGS. 5 and 6, the lid 12 is firmly screwed to the housing 11, as in the second embodiment example. The position of the cam 13 with its scanning face 14, relative to the lid 12 and to the scanning member 16, can be changed by two setscrews 52,53, which each have a formed end for adjusting, and which are screwed through the lid 12 from which they protrude.

Spring pressure is exerted on the cam 13 via one setscrew 52 by a return spring 54 which is supported on the lid 12 and retained by a collar 55 which is formed on the end of the shaft 57 of one setscrew 52 and which passes through the cam 13 within an elongated hole 56; the cam 13 is thus positively locked against the collar 55 of one setscrew 52.

Further, the cam 13 has a vertically directed groove 58, into which a horizontally orientated pin 59, which is fixed in the housing, engages with running clearance and secures the cam 13 during its vertical movement relative to the lid 12 and the scanning member 16, against torsion by changes of the screw-in depth of one setscrew 52 in the lid 12.

The other setscrew 53 engages with an eccentric 62 formed on its shaft 61, in another elongated hole 63, the longitudinal extension of which is at right angles to the pin 59 and the width of which is slightly greater than the diameter of the other shaft 61.

Since the one elongated hole 56 for the one setscrew 52 extends longitudinally toward the pin 59, and since the width of the one elongated hole 56 is slightly larger than the diameter of the one shaft 57, there is a horizontal movement of the cam 13, free from transverse movement, during turning of the setscrew 53 and its eccentric 62 within the range of the eccentric 62.

To seal the speed governor and to secure the position of the cam 13 opposite the lid 12 and the scanning member 16 after the final setting has been completed by the setscrews 52,53, the setting sections 51 of these screws are provided with sealing elements 64 in the form of sealing nuts which have a plastic insert and which lock the two setscrews 52,53 to the lid 12.

The relative adjustment, as shown by the described embodiment examples, of the cam 13 in relation to the lid 12 and the scanning member 16 leads to an final adjustment of the cam 13 which can be made in one work cycle and facilitates an economically advantageous setting of the full load injection volume of the fuel injection pump. In the third embodiment example, the setting can be made even when the speed governor of the fuel injection pump is completely closed.

While the invention has been illustrated and embodied in a fuel injection pump with speed governor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. Fuel injection pump with a speed governor, comprising a housing (11) including a lid (12); a cam (13) mounted on the lid (12); a scanning member (16) for controlling a full load injection volume depending on a number of revolutions, said cam (13) having a scanning face (14) for the scanning member (16); adjusting means for adjusting a position of the cam (13) relative to the lid (12) to determine a position of contact of the scanning member (16) on the scanning face (14) of the cam (13); at least one cap screw (31) passing through the lid (12) and engaging in the cam (13) for adjustment of a vertical displacement of the cam (13) relative to the lid (12); at least one shim (41) insertable between the lid (12) and the cam (13), said at least shim (41) being brought to rest against said lid (12) and said cam (13) by turning said at least one cap screw (31), and wherein said lid (12) is provided with at least one vertically oriented hole (36) and said cam (13) is also provided with at least one vertically oriented hole (37), each of said at least one vertically oriented holes (37) being substantially coaxial with an associated one of said at least one vertically oriented hole (36) of said lid (12); and at least one parallel pin (38) inserted as a guide element in one of said at least one vertically oriented hole (37) and extending into the associated vertically oriented hole (36) to provide an anti-torsion device.

2. Fuel injection pump with a speed governor, comprising a housing (11) including a lid (12); a cam (13) mounted on the lid (12); a scanning member (16) for controlling a full load injection volume depending on a number of revolutions, said cam (13) having a scanning face (14) for the scanning member (16), the means for adjusting a position of the cam (13) relative to the lid (12) and the scanning member (16) comprising at least two setscrews (52,53) screwed through the lid (12) for horizontal and vertical adjustment of the cam (13); adjusting means for adjusting a position of the cam (13) relative to the lid (12) to determine a position of contact of the scanning member (16) on the scanning face (14) of the cam (13); and a return spring (54) between the lid (12) and the cam (13) supported on the lid (12) and surrounding one (52) of the setscrews (52, 53) to provide a pressure on the cam (13) urging the cam (13) away from the lid (12) and a collar (55) on an end of the one setscrew (52) having the return spring (54) and penetrating the cam (13).

3. Fuel injection pump with a speed governor, comprising a housing (11) including a lid (12); a cam (13) mounted on the lid (12); a scanning member (16) for controlling a full load injection volume depending on a number of revolutions, said cam (13) having a scanning face (14) for the scanning member (16), and the scanning member (16) being movable horizontally relative to the cam (13), the means for adjusting a position of the cam (13) relative to the lid (12) and the scanning member (16) comprising at least two setscrews (52,53) screwed through the lid (12) for horizontal and vertical adjustment of the cam (13); and adjusting means for adjusting a position of the cam (13) relative to the lid (12) to determine a position of contact of the scanning member (16) on the scanning face (14) of the cam (13).

4. Fuel injection pump as defined in claim 1, wherein the scanning member (16) is movable horizontally relative to the cam (13).

5. Fuel injection pump as defined in claim 3, further comprising a pin (59) held fixed in the housing (11) and horizontally oriented, said pin (59) being positioned to engage with a running clearance in a groove (58) of the cam (13), said groove (58) extending parallel to each of the setscrews (52,53).

6. Fuel injection pump as defined in claim 5, wherein the scanning surface (14) is curved and the means for adjusting a position of the cam (13) relative to the lid (12) are structured to move the cam (13) vertically relative to the lid (12).

7. Fuel injection pump as defined in claim 6, wherein another one (53) of the set screws (52,53) is provided with a shaft (61) having an eccentric (62) engaged in an elongated hole (63) provided in the cam (13) and elongated in one direction, said eccentric (62) being oriented substantially perpendicular to the pin (59) and another elongated hole (56) is provided in the cam (13) spaced from the one elongated hole (63) and elongated in a direction perpendicular to the direction said elongated hole (63) is elongated so that horizontal adjustment of the cam (13) can be made by turning the other setscrew (53) and displacing the one setscrew (52) in the other elongated hole (56).

8. Fuel injection pump as defined in claim 7, wherein each of the setscrews (52,53) is provided with a sealing element (64) supported on the lid (12).

9. Fuel injection pump as defined in claim 8, wherein each of the sealing elements (64) comprises a sealing nut.

* * * * *